US006186381B1

(12) United States Patent
Kernkamp

(10) Patent No.: US 6,186,381 B1
(45) Date of Patent: Feb. 13, 2001

(54) CHILD CARRIER

(76) Inventor: Anne Kernkamp, 39055 Liefer Rd., Temecula, CA (US) 92591

( * ) Notice: Under 35 U.S.C. 154(b), the term of this patent shall be extended for 0 days.

(21) Appl. No.: 09/193,160

(22) Filed: Nov. 17, 1998

(51) Int. Cl.[7] ..... A61G 1/00
(52) U.S. Cl. ..... 224/161; 224/159; 224/270
(58) Field of Search ..... 224/158, 159, 224/160, 161, 270, 637, 638, 646, 648

(56) References Cited

U.S. PATENT DOCUMENTS

| | | | | |
|---|---|---|---|---|
| D. 252,958 | | 9/1979 | Tatum | D3/31 |
| D. 253,557 | | 12/1979 | Thompson | D3/31 |
| D. 282,697 | | 2/1986 | Allen | D3/31 |
| D. 284,525 | | 7/1986 | Le Maistre | D3/31 |
| D. 363,598 | | 10/1995 | Walters et al. | D3/215 |
| D. 375,184 | | 11/1996 | Hickli et al. | D3/213 |
| D. 393,363 | | 4/1998 | Kataoka | D3/215 |
| 484,065 | | 10/1892 | Taylor . | |
| 576,292 | | 2/1897 | Vanderburgh . | |
| 781,033 | | 1/1905 | Sutter . | |
| 1,196,003 | | 9/1916 | Lippincott . | |
| 1,271,176 | * | 7/1918 | Kureczka | 224/160 |
| 1,330,485 | | 2/1920 | McGinty . | |
| 1,464,404 | | 8/1923 | Blekastad . | |
| 2,056,925 | | 10/1936 | Kimbrough . | |
| 2,409,331 | | 10/1946 | Wood . | |
| 2,411,721 | | 11/1946 | Hancock et al. . | |
| 3,197,100 | | 7/1965 | Thompson . | |
| 3,541,976 | | 11/1970 | Rozas | 108/43 |
| 3,698,608 | | 10/1972 | Entwistle . | |
| 4,029,243 | | 6/1977 | Zerobnick et al. . | |
| 4,068,786 | | 1/1978 | Taniguchi . | |
| 4,149,687 | | 4/1979 | Nunemacher | 224/159 |
| 4,319,704 | | 3/1982 | Rosen | 224/270 |
| 4,389,005 | | 6/1983 | Cable et al. | 224/159 |
| 4,436,233 | | 3/1984 | Hill et al. | 224/159 |
| 4,440,525 | | 4/1984 | Perla | 405/186 |
| 4,544,088 | | 10/1985 | Reding | 224/159 |
| 4,724,987 | | 2/1988 | Maheu | 224/159 |
| 4,790,459 | | 12/1988 | Moseley | 224/159 |
| 4,901,898 | | 2/1990 | Colombo et al. | 224/159 |
| 4,915,277 | | 4/1990 | Larreategui | 224/159 |
| 5,011,056 | | 4/1991 | Larreategui | 224/159 |
| 5,172,838 | | 12/1992 | Rowell et al. . | |
| 5,195,666 | | 3/1993 | Yamaguchi et al. | 224/159 |
| 5,205,450 | * | 4/1993 | Derosier | 224/161 |
| 5,221,032 | | 6/1993 | Bott et al. | 224/270 |
| 5,224,637 | | 7/1993 | Colombo | 224/159 |
| 5,261,584 | | 11/1993 | Albert | 224/270 |
| 5,292,042 | | 3/1994 | Yamaguchi et al. | 224/159 |
| 5,441,186 | | 8/1995 | Halligan | 224/159 |
| 5,492,256 | | 2/1996 | Ive | 224/159 |
| 5,497,923 | * | 3/1996 | Pearson et al. | 224/648 |
| 5,641,101 | | 6/1997 | Nakayama | 224/159 |

* cited by examiner

*Primary Examiner*—Gregory M. Vidovich

(57) ABSTRACT

Child carrier (10) adaptable for carrying a sitting or prone child (90) on the wearer's chest (96), back (97) or hip includes belt (20) adapted for encircling the torso of wearer (95) and removable seat assembly (40). Belt (20) is wider than three inches and includes fastener (23) for cinching belt (20), seat attachment (25), such as pouch (60), for attaching seat assembly (40), and elastic portion (22) providing longitudinal elasticity such that elastic belt (20) may be secured about wearer's chest (96) without discomfort or interference with breathing. In use, belt (20) is cinched about the torso, seat assembly (40) is engaged in seat attachment (25), and child (90) is supported on seat (47). Suspenders (85), selectively attachable to belt (20) at a plurality of locations, distribute weight to shoulders (98) of wearer (95), and also prevent downward slippage of belt (20).

18 Claims, 4 Drawing Sheets

FIG. 1
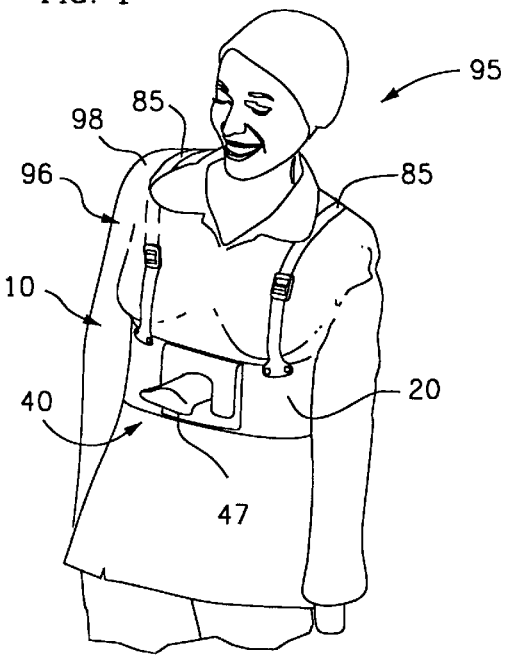
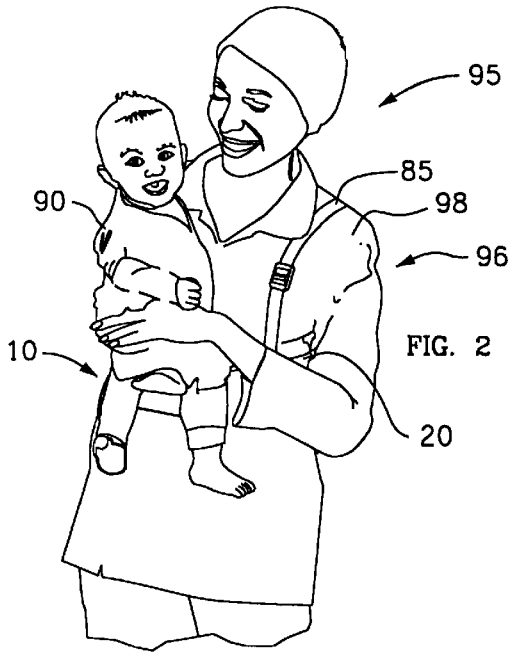
FIG. 2
FIG. 3
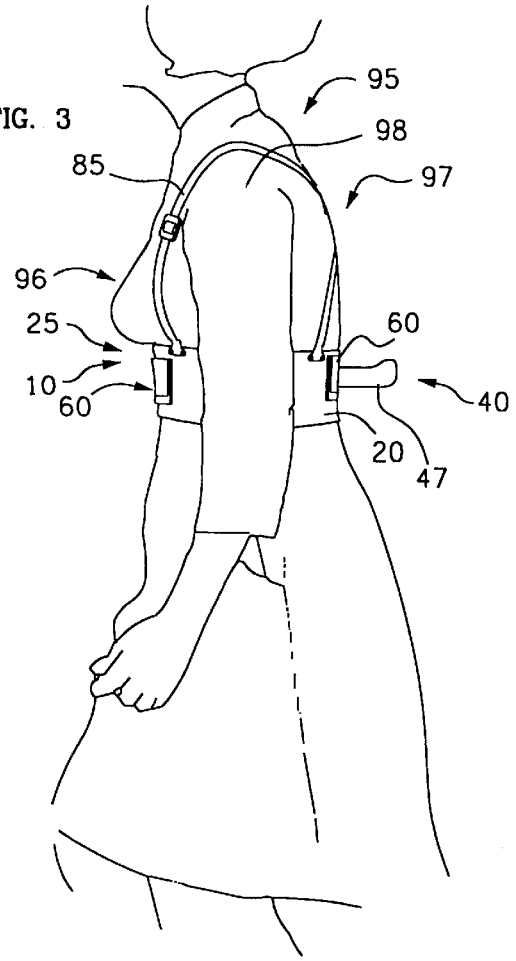
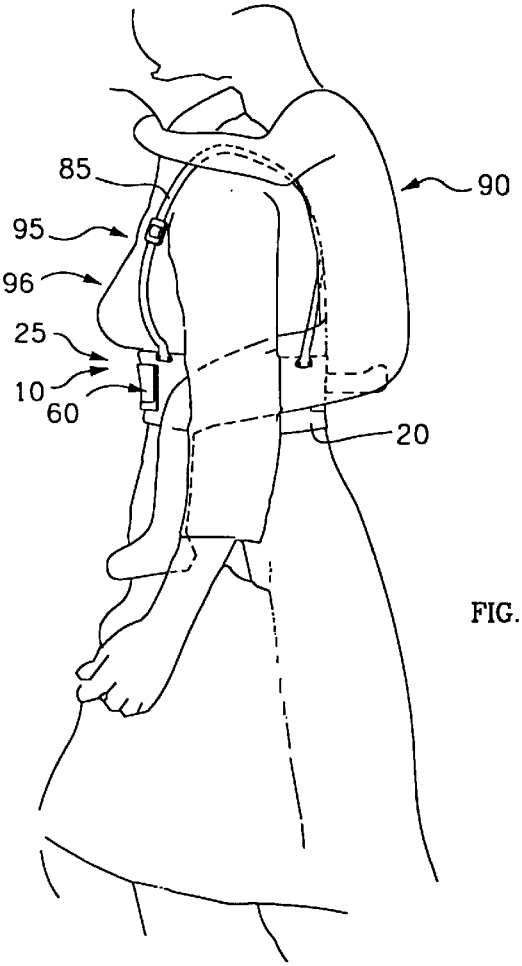
FIG. 4

CHILD CARRIER

FIELD OF THE INVENTION

The invention relates to a carrier worn by an adult for carrying a child, and more particularly to a multi-function child carrier capable of supporting a child, in either a sitting or a prone position, at different locations on the wearer's torso, particularly on the chest and back.

BACKGROUND OF THE INVENTION

It is relatively fast, easy and convenient for an adult to carry a child on the hip. A baby or young child likes to be carried on an adult's hip with his legs straddling the adult. However, the adult often has to bend to a uncomfortable position to retain the child on the hip. Men, particularly, have a difficult time carrying a child in this manner.

As a child grows, the most convenient method of carrying the child changes with the size and weight of the child. For example, newborn infants, who are themselves unable to hold onto an adult, are often carried high up on the chest of an adult. Older toddlers may prefer to be carried on the adult's hip as described above, but this can be uncomfortable and even painful for the adult, especially as the child grows and gains weight. For still older, stronger children, a preferred method is to carry the child on the back, with the child holding onto the adult's shoulders.

There has been a need, therefore, for a device which assists adults in supporting and transporting children in the three modes described above. Adapted for use on the chest, hip, or back, such a child carrier retains its utility as the adult's or the child's needs change.

SUMMARY OF THE INVENTION

A child carrier includes a belt adapted for encircling the torso of the wearer and a selectively removable seat assembly. The belt is generally wider than three inches and includes means for attaching a seat assembly as well as an elastic portion providing longitudinal elasticity. The width and elasticity of the belt provide orthopedic support as well as abdominal support for the wearer, and the elasticity further enables the belt to expand with the wearer's chest so as not to interfere with breathing or cause discomfort.

In use, the belt is cinched about the torso, the seat assembly is engaged in the seat attachment means, and a child is supported on the seat. The child's weight, therefore, is distributed by the belt to a relatively large area of the wearer's torso. Suspenders may be included to distribute the child's weight further to the shoulders of the wearer, and also to prevent downward slippage of the belt.

While the seat assembly is conveniently removable independent of the belt, the invention also encompasses the selective attachment of a plurality of seat assemblies to accommodate multiple children simultaneously. Further, the invention also encompasses adjustable seat attachment means and suspender attachment means, such that the same size belt may offer versatility and accommodate wearers of greatly different sizes.

The seat assembly is capable of operating in two different modes, depending upon which side of the seat is facing upward. One side of the seat is adapted to support a child in a seated position, while the opposed side of the seat is adapted to support a child in a supine position. The seat assembly may be removed from the seat attachment means, inverted, and reinserted to accommodate a child in the desired manner.

The child carrier described herein is capable of being worn low on the torso, around the waist or hips, for carrying a child at the hip, and it is also adapted for use high on the torso, around the chest, for cradling a child in the arms or for carrying a child on the back.

BRIEF DESCRIPTION OF THE DRAWINGS

FIG. 1 is a perspective view of a first embodiment of carrier 10 with seat assembly 40 on the user's chest 96.

FIG. 2 is a perspective view showing carrier 10 of FIG. 1 in use supporting a small child 90.

FIG. 3 is a side elevation view of a second embodiment of carrier 10 in use on the chest 96 of user 95 with seat assembly 40 on the user's back 97.

FIG. 4 is a side elevation view showing carrier 10 of FIG. 3 in use supporting an older child 90.

DETAILED DESCRIPTION OF THE INVENTION

Figure 5:
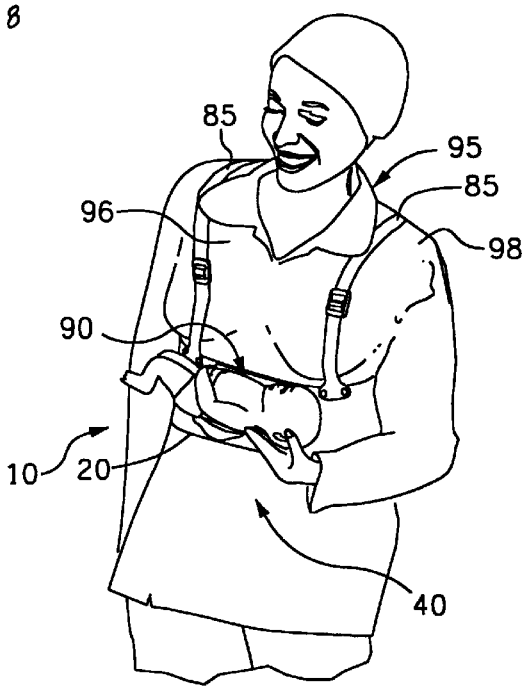
FIG. 5 is a perspective view of a third embodiment of carrier 10 in use with seat assembly 40 on the user's chest 96 supporting a small child 90 in a supine position.

With reference now to the drawings, FIGS. 1 and 2 show perspective views of a first embodiment of carrier 10 in use on the chest 96 of the wearer or user 95. Child carrier 10 generally includes a belt 20 and a seat assembly 40 including a seat 47 upon which baby or child 90 is supported. FIGS. 3 and 4 show side elevation views, with and without an older child 90, respectively, of a second embodiment of carrier 10 in use on the chest 96 of the user 95 with seat assembly 40 on the user's back 97 for use with an older child 90. FIG. 5 shows a perspective view of a third embodiment of carrier 10 in use on the chest 96 of the user 95 with seat assembly 40 on the user's chest 96 for use with an infant or small child 90 in a supine position.

Figure 6:
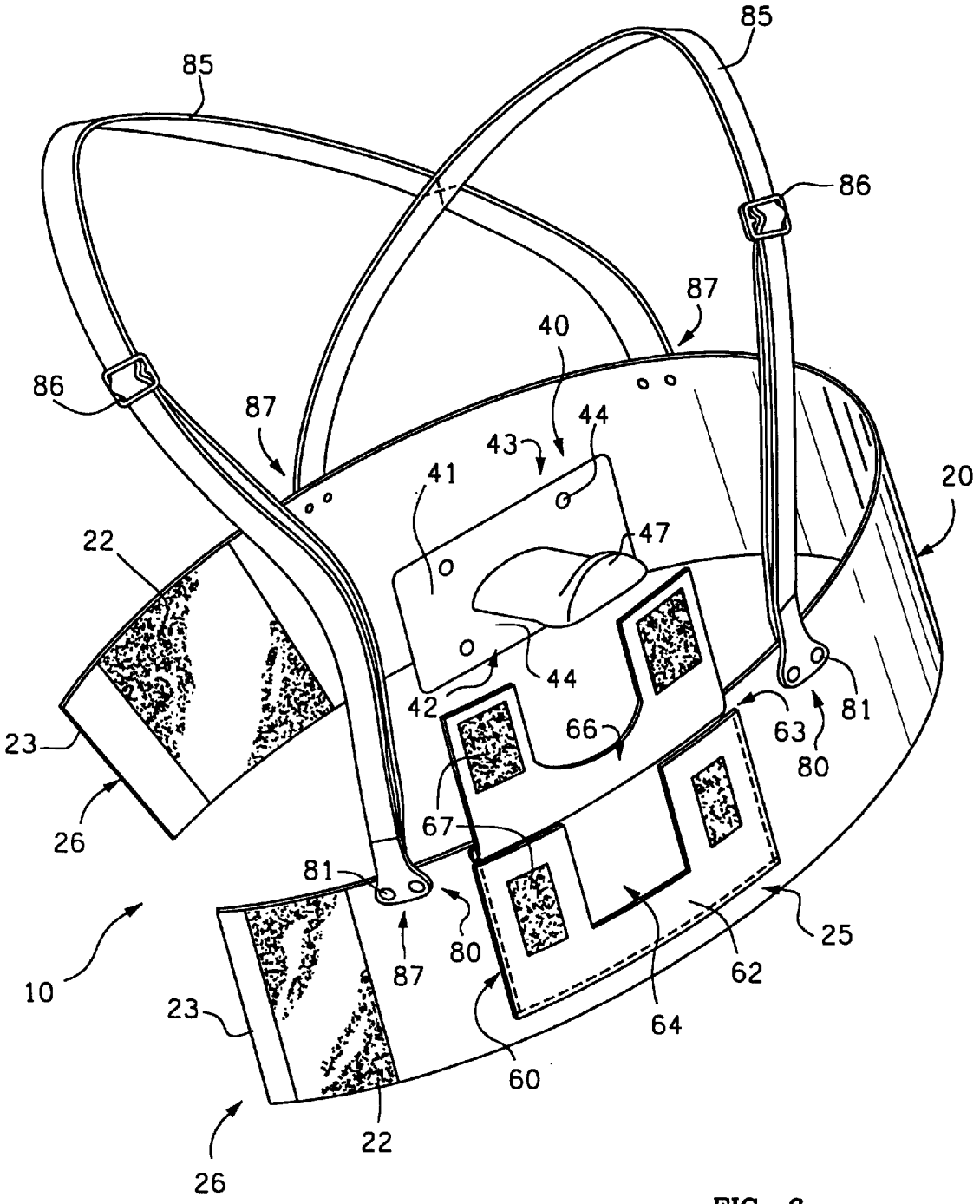
FIG. 6 is a perspective view of a preferred embodiment of carrier 10.

Looking also at FIG. 6, there is shown a perspective view of a preferred embodiment of carrier 10 showing belt 20, seat assembly 40, and suspenders 85. Belt 20 is made of strong material such as nylon, canvas, denim, or other such material as is common in belt manufacture, and cinches around a wearer's hips, waist, or chest 96. Belt 20 is wide, being between three and ten inches in width and preferably between four and eight inches in width. Belt 20 includes a longitudinally elastic portion 22, such that belt 20 has sufficient longitudinal elasticity to enable the wearer 95 to cinch belt 20 tightly around a selected area of the torso, especially around the lower chest, without hindering the wearer's breathing. Elastic portion 22 may encompass all or nearly all of the length of belt 20.

A wide belt 20 helps distribute a child's weight over a broad area of the wearer's torso effectively reducing the load carried by the back muscles. Additionally, the width and elasticity of belt 20 provide broad, firm orthopedic support for the wearer's back and abdominal muscles as the wearer carries the weight of a child. Belt 20 may also include support ribbing (not shown) transverse to the longitudinal axis to supplement the orthopedic support provided.

Belt 20 also includes fastening or cinching means 23 for cinching belt 20 tightly about the wearer's torso. Preferably, cinching means 23 are hook-and-loop type material located near ends 26 of belt 20. Alternatively, cinching means 23 may be clasps, buttons, snaps, a buckle, or other similar belt cinching mechanisms.

To carry child 90 on the chest 96 as seen in FIG. 2, belt 20 of FIG. 6 is cinched on the right side of wearer 95. To carry child 90 on the back 97 as seen in FIG. 4, belt 20 of FIG. 6 is cinched on the left side of wearer 95 and asymmetrical suspenders need to be rotated 180 degrees. To carry child 90 on the left hip, belt of FIG. 6 is cinched on the front of the wearer 95 and suspenders 85 are rotated ninety degrees.

As seen in FIG. 6, belt 20 includes a seat attachment means 25, such as pouch 60, for selectively attaching seat assembly 40 to belt 20.

Figure 9:
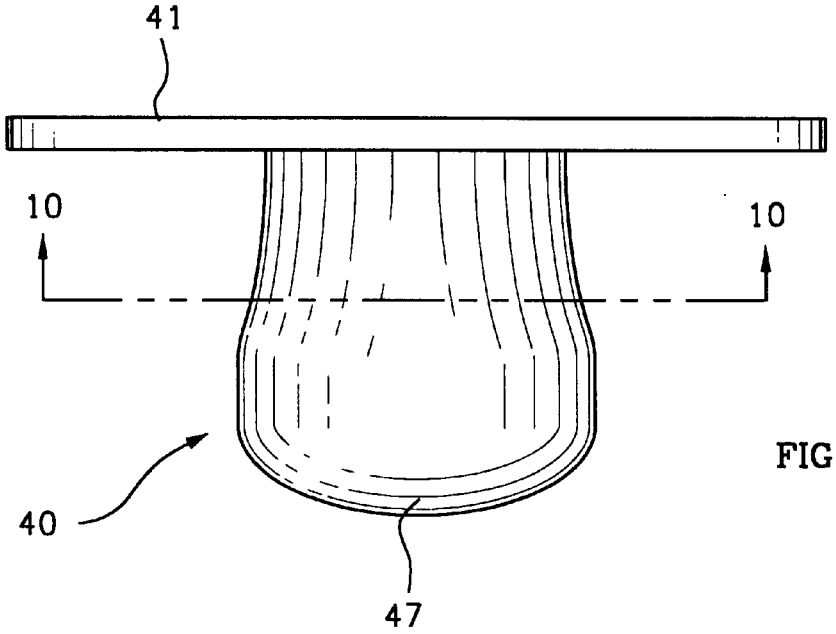
FIG. 9 is a top plan view of seat assembly 40.
Figure 10:
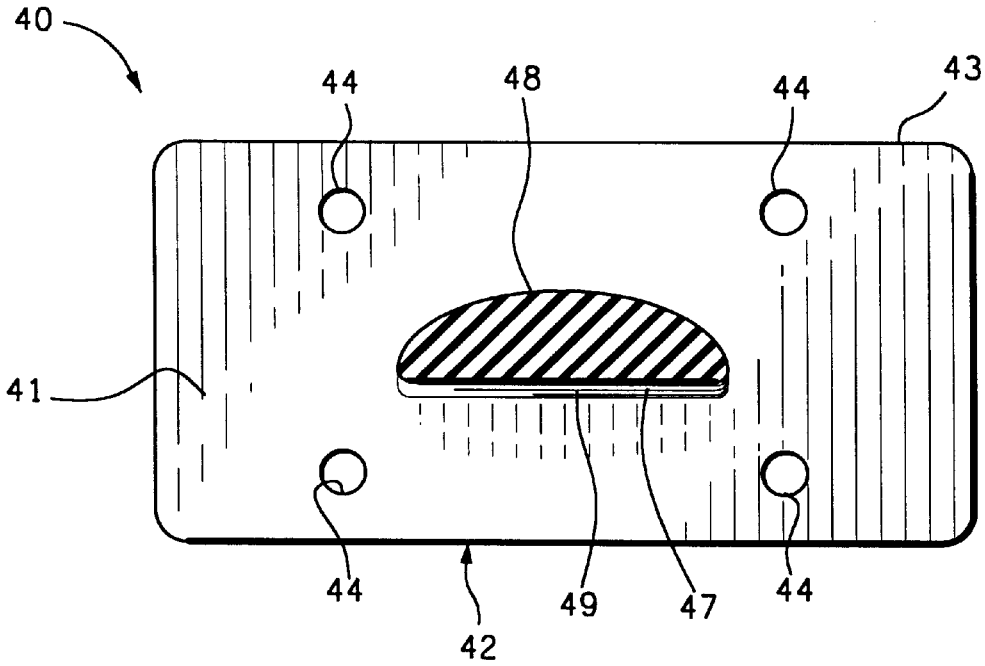
FIG. 10 is a cross-sectional view taken on line 10—10 of FIG. 9.

FIG. 6 shows a perspective view, FIG. 9 shows a top plan view, and FIG. 10 shows a cross-sectional view of seat assembly 40, which includes a backing portion 41 and a seat 47. Seat assembly 40 may be made of plastic, fiberglass, wood, metal, or other material such as is common in fabrication of portable seats. Backing portion 41, including lower end 42 and upper end 43, functions in cooperation with pouch 60 and is adapted to be selectively attached to belt 20 by pouch 60. Seat 47 is attached to backing portion 41 and projects outward therefrom for supporting a child 90 thereon. Seat 47 may be integral with or rigidly attached to backing portion 41, but it is preferable that seat 47 is not hinged or otherwise movably attached to backing portion 41 because movable seats are a potential source of injury to child 90.

Preferably, backing portion 41 is rigid in the vertical direction to resist the moment applied by child's weight on seat 47, but flexible in the horizontal direction to conform to the shape of belt 20 as it encircles the wearer's torso. Backing portion 41 includes finger holes 44 which assist in insertion and removal of backing portion 41 as it is engaged and disengaged with pouch 60.

Seat 47 is generally saddle-shaped as best seen from the top plan view of FIG. 9. Seat 47 includes straddling side 48 and supine side 49. The narrow portion (line 10—10 in FIG. 9) of straddling side 48 is downwardly sloped toward the edges, as best seen in FIG. 10, to accommodate the legs of child 90 seated thereupon. Supine side 49 is substantially planar to provide a flat surface for supporting child 90 in a supine position, as shown in FIG. 5. Seat 47 is therefore capable of supporting child 90 in either a seated or supine position depending upon the orientation of backing portion 41 in pouch 60.

Pouch 60 and backing portion 41 are adapted to cooperate such that backing portion 41 may be inserted into pouch 60 when seat assembly 40 is oriented either with straddling side 48 or with supine side 49 facing upwards. That is, backing portion 41 may be inserted into pouch 60 such that seat assembly 40 is supported with straddling side 48 of seat 47 positioned facing upward for supporting child 90 in a seated position as in FIGS. 2 and 4; alternatively, backing portion 41 may be inverted such that pouch 60 supports seat assembly 40 with supine side 49 of seat 47 positioned facing upward for supporting child 90 in a supine posture as in FIG. 5.

Pouch 60 functions to secure backing portion 41 of seat assembly 40 against belt 20 such that seat 47 is retained in a substantially horizontal position suitable for supporting child 90. Pouch 60 may be fixedly attached, as with stitching or fabric rivets, to belt 20, but the position of pouch 60 may also be adjustable along the length of belt 20 such that the location of seat assembly 40 is selectively variable. Such longitudinal variability of pouch 60 may be accomplished through the use of panels of hook-and-loop type fastening material, or rows of grommets, hooks, or other fastening devices distributed along the length of belt 20 adapted to engage pouch 60 at a selected location. Alternatively, pouch 60 may be slidably connected to belt 20, as through the use of a belt loop or similar mechanism.

The invention also encompasses the simultaneous use of a plurality of seat attachment means 25 at different locations along belt 20. For example, as seen in FIGS. 3 and 4, carrier 10 includes an additional pouch 60 to accommodate an additional seat assembly 40 so as to carry two children; for example, one child 90 on each hip. Alternatively, the adult 95 may cradle one child 90 across the chest 96 and carry another child 90 on the back 97, "piggy-back" style. FIGS. 3 and 4 show a carrier 10 with two pouches 60, one on the user's chest 96, shown without an attached seat assembly 40, and one on the user's back 97 with seat assembly 40 engaged for use.

Figure 7:
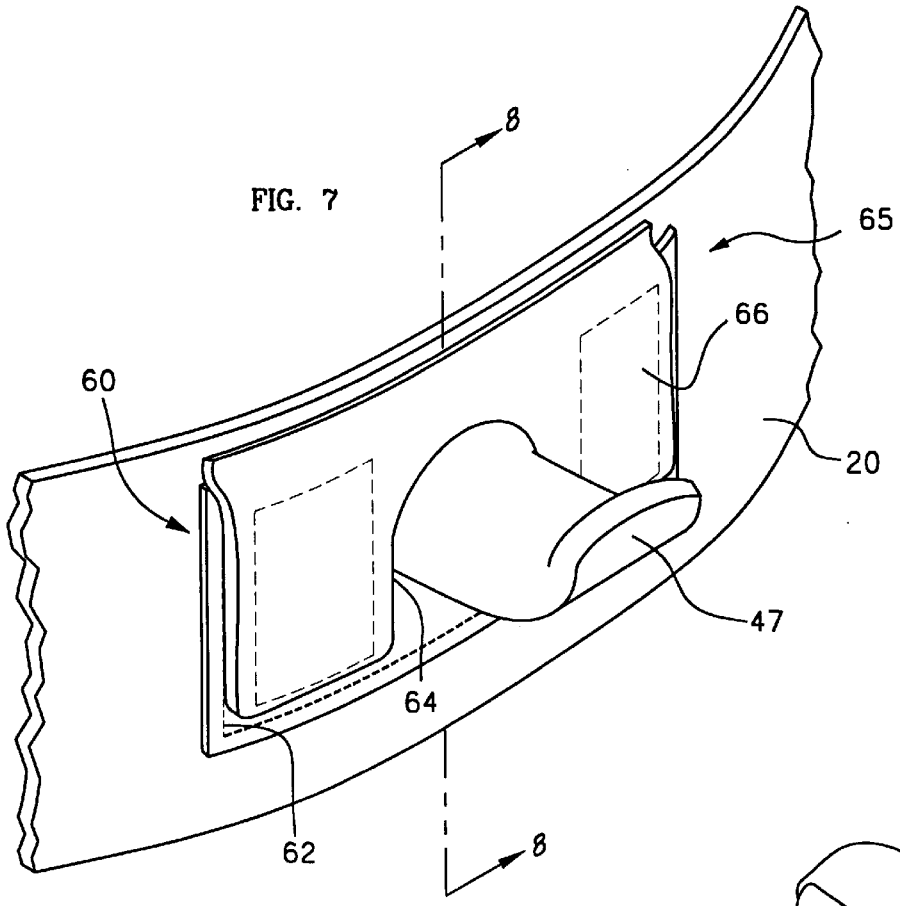
FIG. 7 is a partially cut away perspective view of belt 20 of FIG. 6 showing seat assembly 40 engaged in pouch 60.
Figure 8:
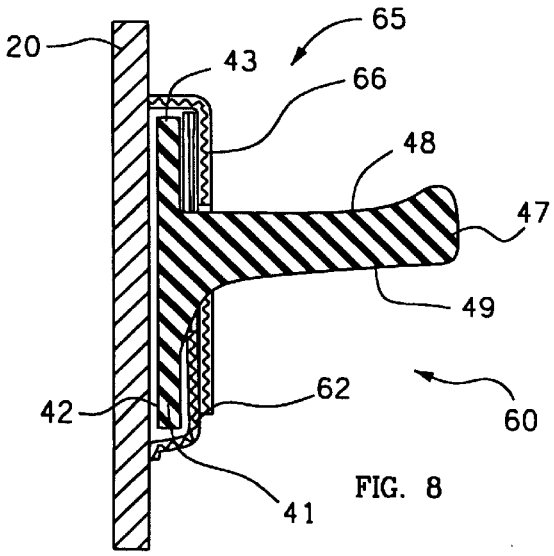
FIG. 8 is a cross-sectional view taken on line 8—8 of FIG. 7.

FIGS. 6 through 8 show the cooperation between pouch 60 and seat assembly 40. When child 90 is supported, the weight on seat 47 tends to force the lower end 42 of backing portion 41 into the wearer's body, causing the upper end 43 of backing portion 41 to separate from belt 20. Pouch 60 prevents outward movement of upper end 43 and downward movement of lower end 42.

Pouch 60 has a first aperture 63 for receiving seat assembly 40. Pouch 60 is connected to belt 20 and secures backing portion 41 such that seat 47 is retained in a substantially horizontal position suitable for supporting child 90. Pouch 60 includes a seat-retention section 62 which, in use, operates to maintain backing portion 41 against belt 20. Seat-retention section 62 includes a second aperture 64 for accommodating the exit of seat 47 from pouch 60. Preferably, pouch 60 includes closure means 65, such as closure flap 66, for securely closing first aperture 63 such that backing portion 41 cannot inadvertently slip out of pouch 60. Flap 66 may be retained in the closed position with suitable fasteners such as patches of hook-and-loop type fastening material, denoted as 67, or buttons or snaps.

FIG. 7 is a partially cut away perspective view and FIG. 8 is a cross-sectional view (taken on line 8—8 of FIG. 7) of carrier 10 showing seat assembly 40 in pouch 60. In FIG. 7, backing portion 41 is hidden from view by seat-retention section 62 of pouch 60. Closure flap 66 is shown in the closed position, and seat 47 is shown extending through second aperture 64.

Other seat attachment means 25 (not shown) are contemplated. For example, belt 20 and backing portion 41 may include cooperating fasteners for attaching seat assembly 40 to belt 20. For example, belt 20 may include grommets and backing portion 41 may include cooperating hooks. A longitudinal row of grommets, integral with belt 20, would allow attachment of seat assembly 40 at desired locations along belt 20.

As best seen in FIGS. 1–6, adjustable-length suspenders 85 are used in conjunction with belt 20. Suspenders 85 may be asymmetrical front to rear as shown or may be symmetrical. Suspender attachment means 80 may be integral with belt 20, such that suspenders 85 are fixedly attached to belt 20, such as with stitching or fabric rivets. However, the locations of suspender attachment means 80, such as buttons or snaps 81, if connected to belt 20, are preferably adjustable along the length of belt 20 such that the location of attachment of suspenders 85 is selectively variable. Such variability may be accomplished in the same ways as with seat attachment means 25, discussed above. Alternatively, suspender attachment means 80 may be integral with suspenders 85 themselves, such as clips, as is typical with clip-on suspenders, such that suspenders 85 are attachable at any location along belt 20.

In the embodiment shown in FIG. 6, buttons or snaps 81 are fixed in location on belt 20. Suspenders 85 may be rearranged, however, by attaching suspender ends 87 to different sets of buttons 81. For example, the embodiment shown in FIG. 6, where pouch 60 is located on the front of the chest of the wearer, is also shown in FIG. 1. To switch to the embodiment shown in FIG. 3, where pouch 60 is located on the back of the wearer, suspenders 85 are simply rotated 180 degrees such that each end 87 is attached to the set of buttons 81 opposite its location shown in FIG. 6.

Suspenders 85 pass over the wearer's shoulders 98 and support belt 20 from the wearer's shoulders 98 at a desired height on the wearer's torso, thereby reducing the risk that belt 20 will slip out of place under the weight of child 90. Suspenders 85 further distribute a child's weight over the shoulders 98 of the wearer 95, relieving tension on the wearer's back muscles. Suspenders 85 are preferably adjustable in length through the use of suspender adjustment buckles 86 so as to support belt 20 at a plurality of positions on the user's torso.

It can be seen that the invention provides a very convenient device for safe and convenient support and transportation of children of various ages and sizes. A baby or child 90 can easily be set on seat 47 and carried without excessive bending by the adult.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

Having thus described my invention, I claim:

1. A child carrier for wearing by a person around the wearer's torso comprising:

a belt, having a width greater than 3 inches and a length adapted for encircling the chest of the wearer; said belt including:

cinching means for cinching said belt around the wearer's torso;

a longitudinally elastic portion providing said belt with sufficient longitudinal elasticity such that the wearer may breathe when said belt is cinched around the wearer's chest;

a seat assembly; and seat attachment means for selectively attaching said seat assembly to said belt; and said seat assembly supported by said seat attachment means including:

a backing portion adapted to cooperate with said seat attachment means for selectively attaching said seat assembly to said seat attachment means; and a seat attached to said backing portion and projecting outward therefrom for supporting a child thereon, said seat includes:

a straddling side adapted to support a child in a seated position; and an opposed supine side adapted to support a child in a supine position; and wherein said seat attachment means and said backing portion cooperate such that said seat assembly may be selectively supported by said seat attachment means such that either said straddling side of said seat faces upward or said supine side of said seat faces upward.

2. The child carrier of claim 1 further including:

suspenders for passing over the wearer's shoulders for supporting said belt from the wearer's shoulders; and suspender attachment means for attaching said suspenders to said belt.

3. The child carrier of claim 1 wherein said backing portion is flexible along the longitudinal direction of said belt so as to conform to the curvature of the wearer's torso when said belt is cinched around the wearer's torso.

4. The child carrier of claim 1 wherein said belt further includes:

additional seat attachment means for selectively attaching said seat assembly, such that a plurality of said seat assemblies may be attached simultaneously to said belt at different locations.

5. The child carrier of claim 2 wherein said suspender attachment means are adapted for selectively attaching said suspenders to said belt at a plurality of locations.

6. A child carrier for wearing by a person around the wearer's torso comprising:

a belt, having a width greater than 3 inches and a length adapted for encircling the chest of the wearer; said belt including:

cinching means for cinching said belt around the wearer's torso;

a longitudinally elastic portion providing said belt with sufficient longitudinal elasticity such that the wearer may breathe when said belt is cinched around the wearer's chest;

a seat assembly; and seat attachment means for selectively attaching said seat assembly to said belt; and said seat assembly supported by said seat attachment means including:

a backing portion adapted to cooperate with said seat attachment means for selectively attaching said seat assembly to said seat attachment means; and a seat attached to said backing portion and projecting outward therefrom for supporting a child thereon;

wherein said seat attachment means comprises:

a pouch, connected to said belt, for securing said backing portion of said seat assembly to said belt such that said seat is retained in a position suitable for supporting a child.

7. The child carrier of claim 6 wherein:

said pouch includes:

a first aperture adapted to receive said backing portion of said seat assembly; and a seat-retention section having a second aperture; said second aperture for accommodating the exit of said seat from said pouch; and wherein said backing portion is adapted for insertion in said pouch and for abutting said belt; and said seat-retention section retains said backing portion against said belt and said seat extends away from the wearer through said second aperture.

8. The child carrier of claim 7 wherein said pouch further includes closure means for securely closing said first aperture.

9. The child carrier of claim 6 further including:

suspenders for passing over the wearer's shoulders for supporting said belt from the wearer's shoulders; and suspender attachment means for attaching said suspenders to said belt.

10. The child carrier of claim 6 wherein said backing portion is flexible along the longitudinal direction of said belt so as to conform to the curvature of the wearer's torso when said belt is cinched around the wearer's torso.

11. The child carrier of claim 6 wherein said belt further includes:

additional pouches for selectively attaching said seat assembly, such that a plurality of said seat assemblies may be attached simultaneously to said belt at different locations.

12. The child carrier of claim 6 wherein:

said seat includes:

a straddling side adapted to support a child in a seated position; and an opposed supine side adapted to support a child in a supine position; and wherein said seat attachment means and said backing portion cooperate such that said seat assembly may be selectively supported by said seat attachment means such that either said straddling side of said seat faces upward or said supine side of said seat faces upward.

13. The child carrier of claim 9 wherein said suspender attachment means are adapted for selectively attaching said suspenders to said belt at a plurality of locations.

14. A child carrier for wearing by a person around the wearer's chest comprising:

a belt, having a width greater than 3 inches and a length adapted for encircling the chest of the wearer; said belt including:

cinching means for cinching said belt around the wearer's chest;

a longitudinally elastic portion providing said belt with sufficient longitudinal elasticity such that the wearer may breathe when said belt is cinched around the wearer's chest;

a seat assembly:

seat attachment means for selectively attaching said seat assembly to said belt; and said seat assembly supported by said seat attachment means including:

a backing portion adapted to cooperate with said seat attachment means for selectively attaching said seat assembly to said seat attachment means; and a seat attached to said backing portion and projecting outward therefrom for supporting a child thereon, said seat includes:

a straddling side adapted to support a child in a seated position; and an opposed supine side adapted to support a child in a supine position; and wherein said seat attachment means and said backing portion cooperate such that said seat assembly may be selectively supported by said seat attachment means such that either said straddling side of said seat faces upward or said supine side of said seat faces upward.

15. The child carrier of claim 14 further including:

suspenders for passing over the wearer's shoulders for supporting said belt from the wearer's shoulders; and suspender attachment means for attaching said suspenders to said belt.

16. The child carrier of claim 14 wherein said backing portion is flexible along the longitudinal direction of said belt so as to conform to the curvature of the wearer's torso when said belt is cinched around the wearer's chest.

17. The child carrier of claim 14 wherein said belt further includes:

additional seat attachment means for selectively attaching said seat assembly, such that a plurality of said seat assemblies may be attached simultaneously to said belt at different locations.

18. The child carrier of claim 15 wherein said suspender attachment means are adapted for selectively attaching said suspenders to said belt at a plurality of locations.

* * * * *